US006000313A

United States Patent [19]

Becker et al.

[11] Patent Number: 6,000,313

[45] Date of Patent: Dec. 14, 1999

[54] CARRIER VEHICLE FOR A TUBE WEAPON

[75] Inventors: Wilfried Becker; Hans-Ulrich Desgranges, both of Celle; Uwe Eisenkolb, Fassberg/Müden; Heinz Haas, Suderburg; Udo Weinfurth, Düsseldorf, all of Germany

[73] Assignee: Rheinmetall Industrie AG, Ratingen, Germany

[21] Appl. No.: 09/046,507

[22] Filed: Mar. 24, 1998

[30] Foreign Application Priority Data

Mar. 27, 1997 [DE] Germany ..... 197 13 192

[51] Int. Cl.[6] ..... F41A 23/00; B64D 1/04

[52] U.S. Cl. ..... 89/40.02; 89/1.35

[58] Field of Search ..... 89/40.02, 37.05, 89/1.35, 37.13, 40.03, 40.09

[56] References Cited

U.S. PATENT DOCUMENTS

| | | | |
|---|---|---|---|
| 2,549,835 | 4/1951 | McCann et al. | 89/40 |
| 2,818,781 | 1/1958 | Ruf | 89/40 |
| 2,905,057 | 9/1959 | Herlach | 89/40 |
| 3,760,684 | 9/1973 | LaSpisa et al. | 89/37 C |
| 3,866,515 | 2/1975 | Ziegler et al. | 89/37 |
| 4,489,639 | 12/1984 | Winkler et al. | 89/46 |
| 4,548,122 | 10/1985 | Hansson et al. | 89/37.05 |
| 4,791,852 | 12/1988 | Fraud et al. | 89/40.02 |
| 5,604,327 | 2/1997 | Skoglund | 89/46 |

*Primary Examiner*—Charles T. Jordan
*Assistant Examiner*—Jeffrey Howell
*Attorney, Agent, or Firm*—Venable; Norman N. Kunitz

[57] ABSTRACT

A carrier vehicle (1) for a tube weapon (2) having a resiliently arranged undercarriage (3) and a support arrangement (5) which in the combat-ready position is arranged between the vehicle (1) and the ground (4), with the support arrangement comprising at least one support (6). To avoid manual readjustment of the support arrangements (5), even when firing from a position with a soft underground, the supports (6), which are disposed at the tail of the vehicle (1), are arranged so as to be slidable in the direction of their longitudinal axes (7) via a positioning motor (15). The positioning motor (15) is connected to an electronic control device (16) which actuates the positioning motor (15) in a manner such that the support (6) is pressed against the ground (4) with a definable force before a shot is fired and compensation is provided for the gap (18) which occurs between the support (6) and the ground (4) after a shot has been fired because of the resilient yielding and rebounding of the undercarriage (3).

9 Claims, 3 Drawing Sheets

CARRIER VEHICLE FOR A TUBE WEAPON

REFERENCE TO RELATED APPLICATIONS

This application claims the priority of German application No. 197 13 192.1, filed Mar. 27, 1997, which is incorporated herein by reference.

BACKGROUND OF THE INVENTION

The invention relates to a carrier vehicle for a tube weapon having a resiliently arranged undercarriage and having at least one support arrangement which, in the combat position, is arranged between the vehicle and the ground, with the support arrangement comprising at least one support which transmits at least a portion of the recoil forces acting on the vehicle during the firing of the ammunition into the ground via a ground-side pedestal.

If light-weight vehicles are used as weapon carriers for tube weapons, the recoil forces are so large, in particular, when large-caliber tube weapons are used, that they must be guided into the ground with the assistance of a support arrangement acting in addition to the vehicle. This is the case especially if, owing to the space conditions in the vehicle, the recoil forces are transmitted into the vehicle at a large distance from the center of gravity of the vehicle.

Frequently, folding or hinged supports with ground spades are used as the support arrangements. The ground spades can be anchored in the ground with the help of the respective vehicle propulsion system. Furthermore, the use of telescopic supports as support arrangements has been disclosed, with the supports being moved hydraulically or manually via a threaded spindle.

The drawback of the known carrier vehicles mainly is that the recoil forces induce the vehicles to vibrate because of the resiliently seated undercarriages. Furthermore, on soil with growth, settling phenomena occurs with high-powered weapons. The vibrations of the vehicle and the settling phenomena lead to the fact that, on the one hand, the crew of the vehicle is exposed to jerky loads during firing and that, on the other hand, displacements of the carrier vehicle occur which necessitate rather large aiming corrections for the respective subsequent firing.

It is the object of the present invention to provide a carrier vehicle of the type mentioned at the outset, wherein a manual resetting of the support arrangements can be omitted, even if firing takes place from a position with soft underground, without negatively influencing the target or aiming accuracy of the tube weapon.

SUMMARY OF THE INVENTION

The above object generally is achieved according to the present invention by a carrier vehicle for a tube weapon comprising: a carrier vehicle having a resiliently arranged undercarriage; a tube weapon mounted on the vehicle; at least one support arrangement mounted on the vehicle and, which, in a combat position, is arranged between the vehicle and the ground, with the support arrangement comprising at least one support which transmits at least a portion of the recoil forces acting on the vehicle during the firing of the ammunition into the ground via a ground-side pedestal; and wherein the at least one support of the support arrangement is mounted so as to be slidable in a direction of its longitudinal axis via a positioning motor: and, the positioning motor is connected to an electronic control means for actuating the positioning motor such that the support is pressed against the ground with a defined force before a shot is fired, whereby compensation is provided for a gap which might occur between the support and the ground after a shot has been fired because of the resilient yielding and rebounding of the undercarriage.

Further advantageous features of the invention are disclosed and discussed below.

Essentially, the invention is based on the concept of arranging the supports, which are usually disposed at the tail of the vehicle, so as to be slidable in the direction of their longitudinal axis by means of a positioning or adjusting motor. Here, the supports are pressed against the ground with a defined force, so that the undercarriage is relieved to a certain extent. The defined force ensures that the undercarriage as well as the supports are loaded during firing. The positioning motor is connected to an electronic control device which actuates the positioning motor such that the support is pressed against the ground with a defined force before a shot is fired, and that the gap which forms between the support and ground after a shot has been fired is compensated because of the resilient yielding and rebounding of the undercarriage.

It proved to be particularly advantageous in the carrier vehicle of the invention that the overall structure of the vehicle is loaded evenly since the contact conditions can be defined almost independently of the ground through the supports.

In an advantageous embodiment of the invention, the respective support of the support arrangement comprises a support tube provided with an external thread and a ground-side pedestal. The support tube is arranged in a partial region inside of a nut, which is pivotally seated and provided with an internal thread, in such a manner that the internal thread of the nut engages the external thread of the support tube, and that the nut can be turned by the positioning motor via a pinion.

The drives of the supports can be automated in a simple manner if the positioning motor is an electric motor because the torque is proportional to the current strength of the motor and can serve as a control value for the contact pressure. Therefore, the electronic control arrangement preferably comprises a threshold circuit. Before a respective shot is fired, the threshold circuit compares the motor current appearing after the positioning motor has been switched on with a predetermined threshold value and switches off the positioning motor as soon as the motor current reaches the threshold value. This permits a simple automation of the drives of the supports.

According to a further feature of the invention, the support tube of the support is connected to the ground-side pedestal via a ball-and-socket joint.

Further details and advantages of the invention result from the embodiments below which are explained by way of figures.

DETAILED DESCRIPTION OF THE PREFERRED EMBODIMENT

Figure 1:
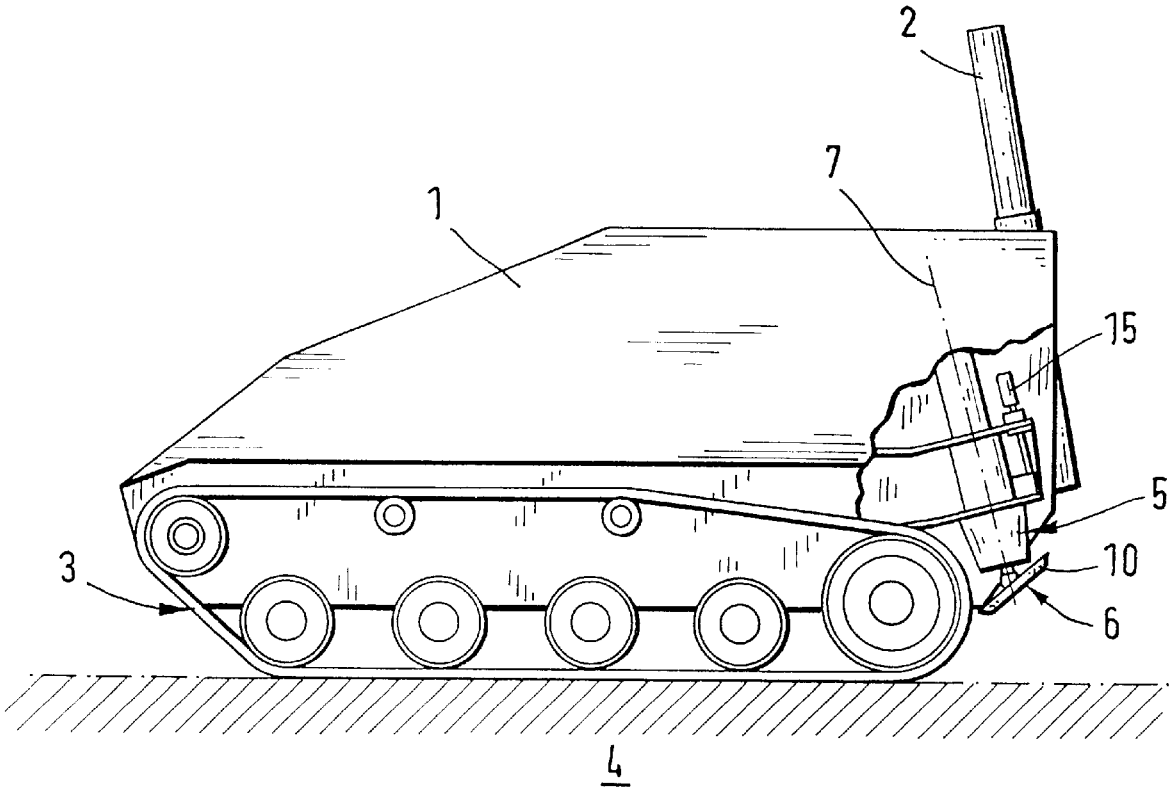
FIG. 1 is a side view of a carrier vehicle according to the invention having a tube weapon and a tail-side support arrangement, with the supports being in the retracted state.

Referring now to FIGS. 1–5, there is shown a carrier vehicle 1 having a high-angle weapon 2, e.g., a mortar, arranged at its tail end. With its undercarriage 3, the carrier vehicle 1 stands on the ground 4 in a combat position. Also mounted at the tail end of the carrier vehicle 1, is a support arrangement 5 having two supports 6 (each figure shows only one support 6). Each support 6 is arranged so as to be slidable along its respective longitudinal axis 7. In FIG. 1, the supports 6 are shown in their retracted state. In FIGS. 2–5 the supports 6 are shown in their extended state and are each comprised of a support tube 9 provided with an external thread 8 (FIG. 6) and a ground-side pedestal 10.

Figure 6:
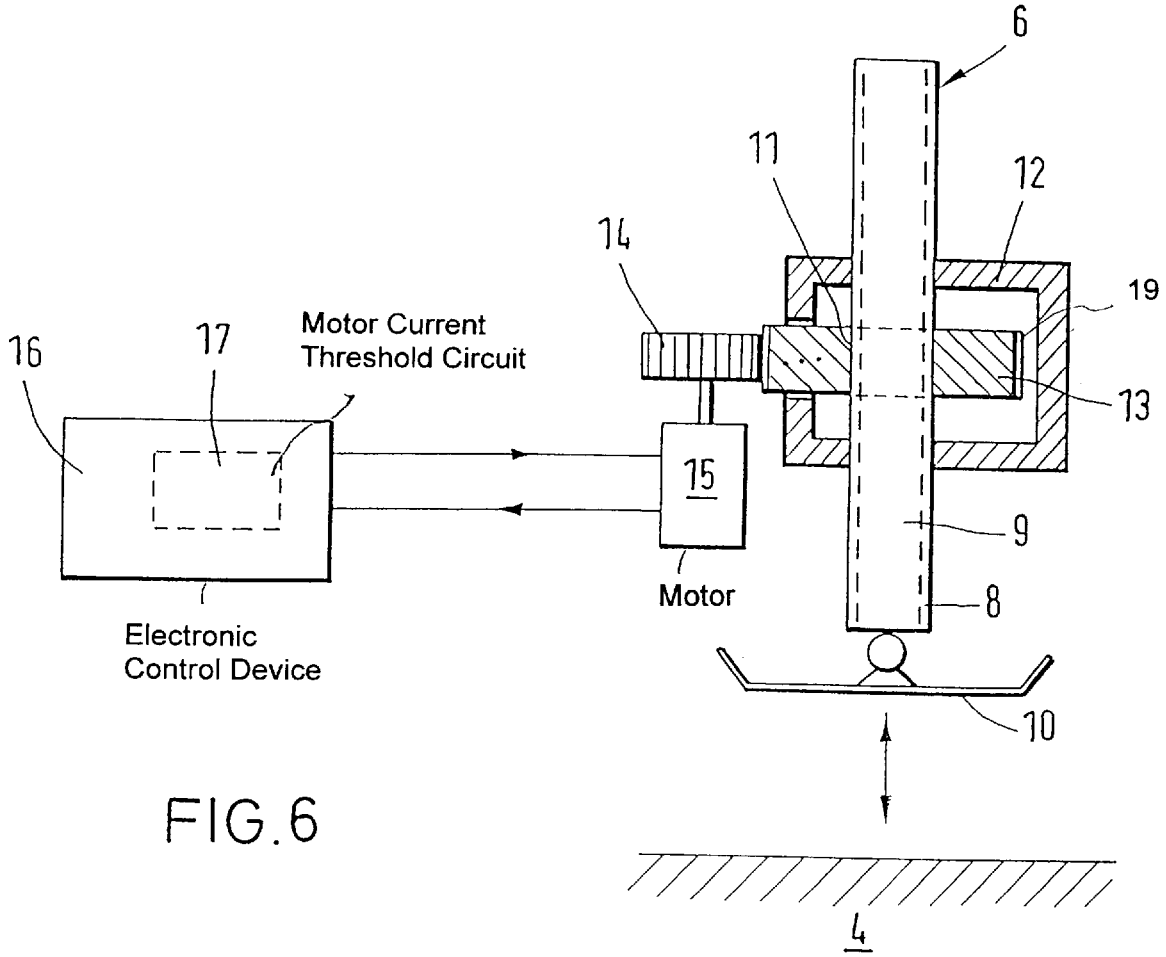
FIG. 6 shows an embodiment of a support arrangement according to the invention which is coupled to a positioning motor, with the positioning motor being connected to an electronic control device.

In addition to the supports 6, and as shown in FIG. 6, the support arrangement 5 also comprises respective nuts 13, which are each associated with a respective support 6 and are each pivotally disposed in a housing 12. Each nut 13 embraces the respective support tube 9 in a partial region in a manner such that the internal thread 11 of the nut 13 engages the external thread 8 of the respective support tube 9.

Via a respective pinion 14, which engages external gear teeth 19 on the exterior surface of the associate respective nut 13, each nut 13 of the support arrangement 5 is connected to an electric motor (positioning motor) 15 which, in turn, is actuated by an electronic control device 16. The electronic control device includes a threshold circuit 17 whose function will be explained below.

Figure 2:
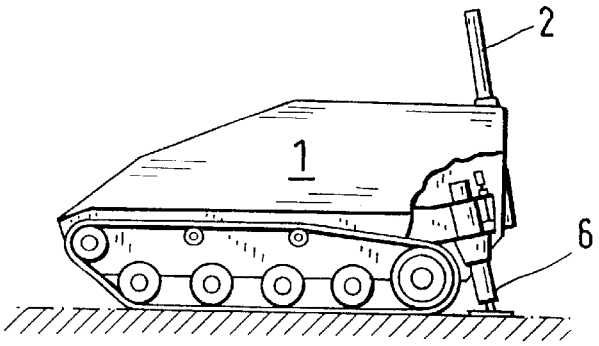
FIGS. 2–5 are side views of the carrier vehicle illustrated in FIG. 1 with extended supports before, during and after the firing of a shot.

In the following, the mode of operation of the carrier vehicle during the firing of a shot is explained in greater detail by way of FIGS. 2–6:

Prior to firing a shot from the weapon 2, the supports 6 of the support arrangement 5 are extended and are pressed against the ground 4 with a defined force (FIG. 2). For this purpose, the control device 16 actuates the electric motor 15 accordingly. The motor 15 moves the pinion 14 which turns the nut 13. The supports 6 are then moved because of the engagement of the internal thread 11 of the nut 13 in the, preferably self-locking, external thread 8 of the support tube 9.

As soon as the motor current exceeds a predetermined threshold value of the threshold circuit 17, the electric motor 15 is switched off and a firing clearance signal is provided.

Figure 3:
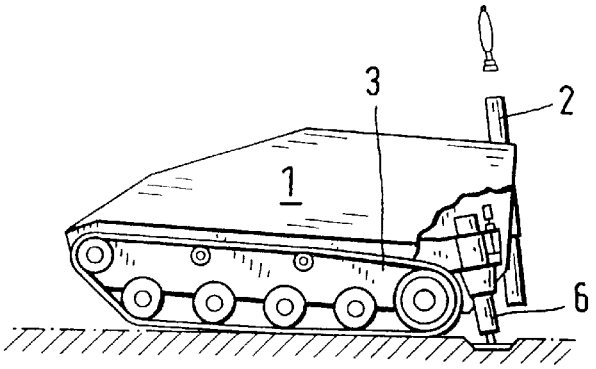
Figure 4:
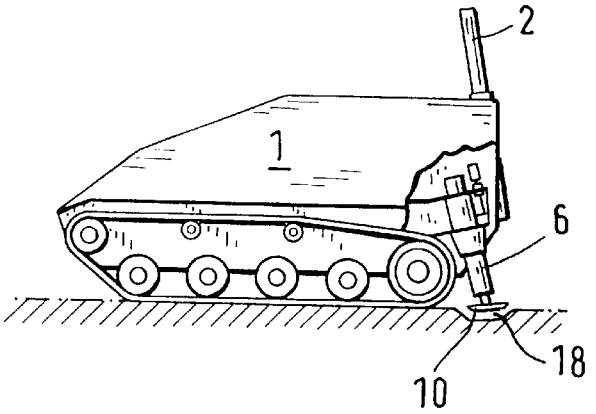
Figure 5:
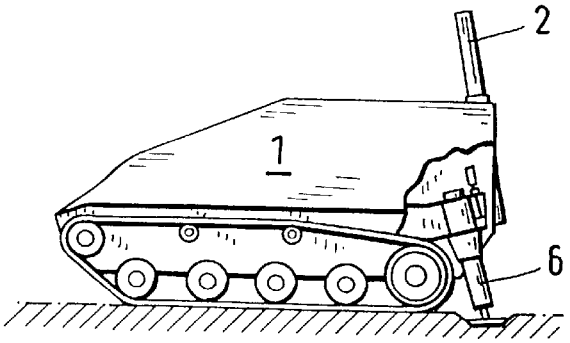

During the firing, the muzzle impulse of the projectile of the respective ammunition is transmitted via the (recoiling) weapon and the vehicle structure to the resiliently yielding undercarriage 3 and to the supports 6 which press themselves into the ground 4 (FIG. 3). After the firing, the supports 6 are then first lifted off the flattened or, pushed-in ground by the rebounding undercarriage 3 (FIG. 4), so that a gap 18 between the pedestal 10 of the respective support 6 and the ground 4 is formed. Subsequently, the supports 6 are again pressed against the ground 4 through a readjustment by means of the electronic control device 16 (FIG. 5).

The invention is, of course, not limited to the above-described embodiment. For example, the positioning motor 15 need not necessarily be an electric motor. Rather, a fluid-driven motor may also be considered if the electronic control device 16 is designed for a motor of this type.

Furthermore, the threshold circuit 16 need not necessarily be comprised of a hardware configuration but can also be realized in the form of software, especially if a control device 16 is used that is provided with a microcomputer.

The invention now being fully described, it will be apparent to one of the ordinary skill in the art that many changes and modifications can be made thereto without departing from the spirit or scope of the invention as set forth herein.

What is claimed:

1. Carrier vehicle for a tube weapon comprising: a carrier vehicle having a resiliently arranged undercarriage; a tube weapon mounted on the vehicle, at least one support arrangement mounted on the vehicle and, which support arrangement, in a combat position, is arranged between the vehicle and the ground, with the support arrangement comprising at least one support which transmits at least a portion of the recoil forces acting on the vehicle during the firing of the ammunition into the ground via a ground-side pedestal; and wherein means are provided to mount the at least one support of the support arrangement to be slidable in a direction of its longitudinal axis via a positioning motor: and, the positioning motor is connected to an electronic control means for actuating the positioning motor such that the support is pressed against the ground with a defined force before a shot is fired, whereby compensation is provided for a gap which might occur between the support and the ground after a shot has been fired because of the resilient yielding and rebounding of the undercarriage.

2. A carrier vehicle according to claim 1, wherein the tube weapon and the support arrangement are arranged on a tail end of the carrier vehicle.

3. A carrier vehicle according to claim 1, wherein the tube weapon is a high-angle weapon.

4. A carrier vehicle according to claim 1, wherein the at least one support includes a support tube and the ground-side pedestal, with the support tube being connected to the pedestal via a ball-and-socket joint.

5. A carrier vehicle according to claim 1, wherein: the support tube is provided with an external thread and is arranged in a partial region inside of a nut with an internal thread, which nut is pivotally seated and provided with an internal thread; the internal thread of the nut engages the external thread of the support tube; and the positioning motor is connected to the nut via a pinion in order to turn the nut and position the support.

6. A carrier vehicle according to claim 5, wherein the positioning motor is an electric motor.

7. A carrier vehicle according to claim 6, wherein the electronic control means includes a threshold circuit for, before the firing of a respective shot, comparing the motor current appearing after the positioning motor has been switched on with a predetermined threshold value and for only switching off the positioning motor when the motor current reaches the threshold value.

8. A carrier vehicle according to claim 1, wherein the positioning motor is an electric motor.

9. A carrier vehicle according to claim 8, wherein the electronic control means includes a threshold circuit for, before the firing of a respective shot, comparing the motor current appearing after the positioning motor has been switched on with a predetermined threshold value and for only switching off the positioning motor when the motor current reaches the threshold value.

* * * * *